US007677424B2

(12) United States Patent
Yoshida

(10) Patent No.: US 7,677,424 B2
(45) Date of Patent: Mar. 16, 2010

(54) PORTABLE SHOEHORN

(75) Inventor: Tsukasa Yoshida, Tokyo (JP)

(73) Assignee: NS Planning Inc., Tokyo (JP)

( * ) Notice: Subject to any disclaimer, the term of this patent is extended or adjusted under 35 U.S.C. 154(b) by 810 days.

(21) Appl. No.: 10/535,178

(22) PCT Filed: Mar. 11, 2004

(86) PCT No.: PCT/JP2004/003209

§ 371 (c)(1),
(2), (4) Date: Feb. 15, 2006

(87) PCT Pub. No.: WO2004/098356

PCT Pub. Date: Nov. 18, 2004

(65) Prior Publication Data

US 2006/0151551 A1 Jul. 13, 2006

(30) Foreign Application Priority Data

May 9, 2003 (JP) ..... 2003-131967

(51) Int. Cl.
*A47G 25/82* (2006.01)

(52) U.S. Cl. ..... 223/118; 222/113

(58) Field of Classification Search ..... 223/111–119
See application file for complete search history.

(56) References Cited

U.S. PATENT DOCUMENTS 1,424,030 A 7/1922 Peck
D208,894 S * 10/1967 Wedermeyer ..... D28/91.2
3,501,073 A * 3/1970 Joachim-Hans ..... 223/118
3,952,754 A * 4/1976 Kondo ..... 132/120
4,067,487 A 1/1978 Carr et al.
4,615,066 A * 10/1986 Colognori ..... 15/244.1
5,185,902 A * 2/1993 Fong ..... 15/105
6,221,034 B1 * 4/2001 Chaplin ..... 601/137
2006/0151551 A1 * 7/2006 Yoshida ..... 223/118

FOREIGN PATENT DOCUMENTS

JP 2002-306554 * 10/2002
JP 20002-306554 A 10/2002
JP 2006-280287 * 10/2004

* cited by examiner

*Primary Examiner*—Shaun R Hurley
*Assistant Examiner*—Andrew W Sutton
(74) *Attorney, Agent, or Firm*—Sughrue Mion, PLLC

(57) ABSTRACT

A portable shoehorn that can be easily and quickly be used by a user to put on his/her shoes, scratch his/her back when itchy, and massage a part of his/her body when stress is to be relieved. In the portable shoehorn 1, a plate member, which is bent in the breadth direction, is also bent in the longitudinal direction approximately like a bow into a slender plate to form a shoehorn and a grip section 1*a* is fold into two at the central portion to reduce the total length approximately by half. A backscratcher 2 is formed at the tip of the grip section 1*a* and an elastic body 3 for patting the body is mounted attachably/detachably to the backscratcher 2 and to the shoehorn portion 1*b* of the shoehorn section.

6 Claims, 6 Drawing Sheets

PORTABLE SHOEHORN

This is a National Stage entry of International Application PCT/JP2004/003209, with an international filing date of Mar. 11, 2004, which was published under PCT Article 21(2) as WO Publication 2004/098356 A1, and the complete disclosure of which is incorporated into this application by reference.

TECHNICAL FIELD

The present invention relates to a portable shoehorn which can be carried around in a bag at any time.

BACKGROUND ART

A portable shoehorn, in which a shoehorn formed in a slender and flat plate shape with the same shape which is bent in the breadth direction and a backscratcher are jointed together at each supporting end with a pin, has been well known so far.

The above-described conventional portable shoehorn has a configuration in which a backscratcher and a shoehorn which are conventionally individual products, are integrated to one unit such that the conventional portable shoehorn can be carried in a bag, and can be used in quick response to requirements while a user is going out, for example, during traveling. These examples are disclosed in Japanese Patent Application Laid-Open No. 2002-306554.

On the other hand, when a person takes the same posture for a long time, for example, at traveling, he/she wish to take an action for better circulation of blood by relieving a part of his/her body.

However, the above-described conventional portable shoehorn has been not provided with the above relieving function. Accordingly, it has been required that a tool which is carried, for example, at travelling is provided with the above relieving function.

The present invention has been made, in view of the above-described circumstances, and an object thereof is to provide a portable shoehorn which can be easily and quickly used when a user puts on his/her shoes, his/her backs are itchy, and a part of his/her body are required to be relieved.

DISCLOSURE OF THE INVENTION

A portable shoehorn according to the present invention is a shoehorn obtained by bending a plate member which has been bent a breadth direction thereof, in a longitudinal direction thereof approximately like a bow to form a slender plate shape, where a grip section of the shoehorn is folded into two parts at a central portion to reduce the entire length thereof approximately by half.

Moreover, the portable shoehorn according to the present invention has a configuration in which a backscratcher is formed at a distal end portion of the grip section and an elastic body for patting a human body is attachably/detachably mounted to the backscratcher and to the shoehorn portion of the shoehorn.

According to the above-described portable shoehorn of the present invention, the portable shoehorn can be easily and quickly used, while being carried during his/her travelling, such that the shoehorn portion of the shoehorn is used when a user puts on his/her shoes, the backscratcher is utilized when his/her back is itchy, and the elastic body for patting a human body pat his/her body like a shoulder tapper when a part of his/her body is required to be relieved, because the portable shoehorn has a configuration in which the portable shoehorn can be folded and can be also used as a backscratcher and a tool with a function for patting a human body.

BEST MODE FOR CARRYING OUT THE INVENTION

Hereinafter, a portable shoehorn according to an embodiment of the present invention will be explained, referring to drawings.

A portable shoehorn 1 (refer to FIGS. 1A and 1B) is a shoehorn obtained by bending a plate member, which has been bent in a breadth direction thereof, in a longitudinal direction thereof approximately like a bow to form a slender plate shape, where a grip section 1*a* of the shoehorn is foldable into two parts at a central portion thereof to reduce the entire length of the grip section 1*a* approximately by half.

Further, the portable shoehorn 1 is constituted such that a backscratcher 2 is formed at a distal end portion of the grip section 1*a* and an elastic body 3 for patting a human body is attachably/detachably mounted to the backscratcher 2 and a shoehorn portion 1*b* of the shoehorn.

The grip section 1*a* in this embodiment is formed to be narrower in breadth than those of the portion of backscratcher 2 and the shoehorn portion 1*b* of the shoehorn.

Here, the grip section 1*a* comprises two members which are rotatably jointed at a central portion with a pin 4, and the central portion is also configured to be the same in breadth as those of the backscratcher 2 and the shoehorn portion 1*b* of the shoehorn.

The backscratcher 2 according to this embodiment comprises a plurality of corrugated projections 2*b* provided at a bent end of a bent portion 2*a* made by bending a distal end portion and a plurality of small projections 2*c* provided at right and left edge portions nearer to the bent portion 2*a*.

Figure 2:
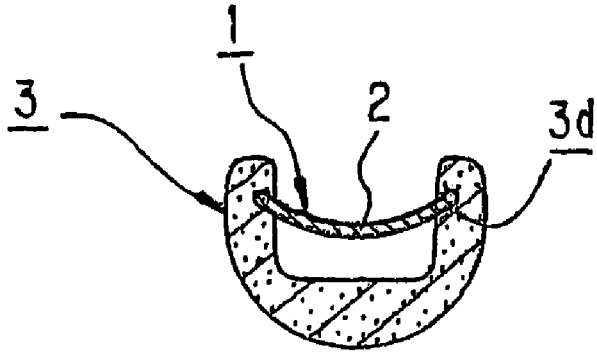
FIG. 2 is a sectional view of the portable shoehorn taken along line B-B in FIG. 1A.
Figure 3:
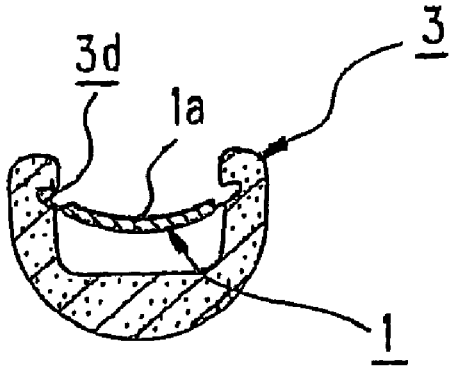
FIG. 3 is a sectional view of the portable shoehorn taken along line C-C in FIG. 1A.
Figure 4:
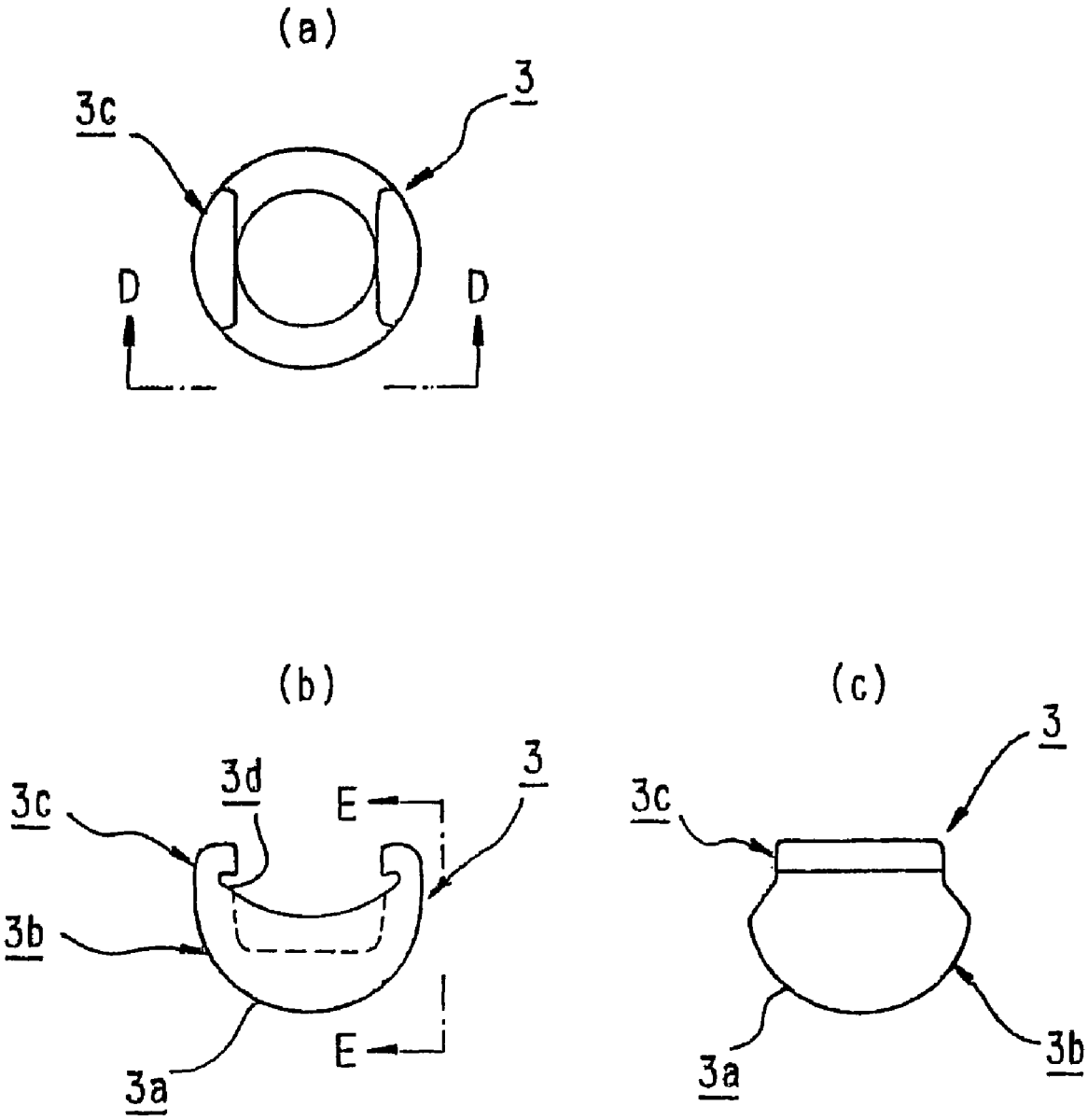
FIG. 4A is a schematic view of an elastic body for patting a human body used for the portable shoehorn according to the present invention.
FIG. 4B is a side view of the elastic body as viewed in a direction of arrow line D-D in FIG. 4A.
FIG. 4C is a side view of the elastic body as viewed in a direction of arrow line E-E in FIG. 4B.

The elastic body 3 for patting a human body according to this embodiment comprises: a main body portion 3*b* having a spherically-shaped contacting surface 3*a* with a human body; and mounting portion 3*c* which are applied to be mounted to the backscratcher 2 and the shoehorn portion 1*b* of the shoehorn, as shown in FIGS. 2 through 4.

An engagement groove 3*d* with a groove breadth which does not allow engagement with the grip section 1*a* (Refer to FIG. 3) but allows engagement with the backscratcher 2 and the shoehorn portion 1*b* of the shoehorn are engaged (Refer to FIG. 2) is formed in the mounting section 3*c* of the elastic body 3 for patting a human body according to this embodiment.

Figure 1:
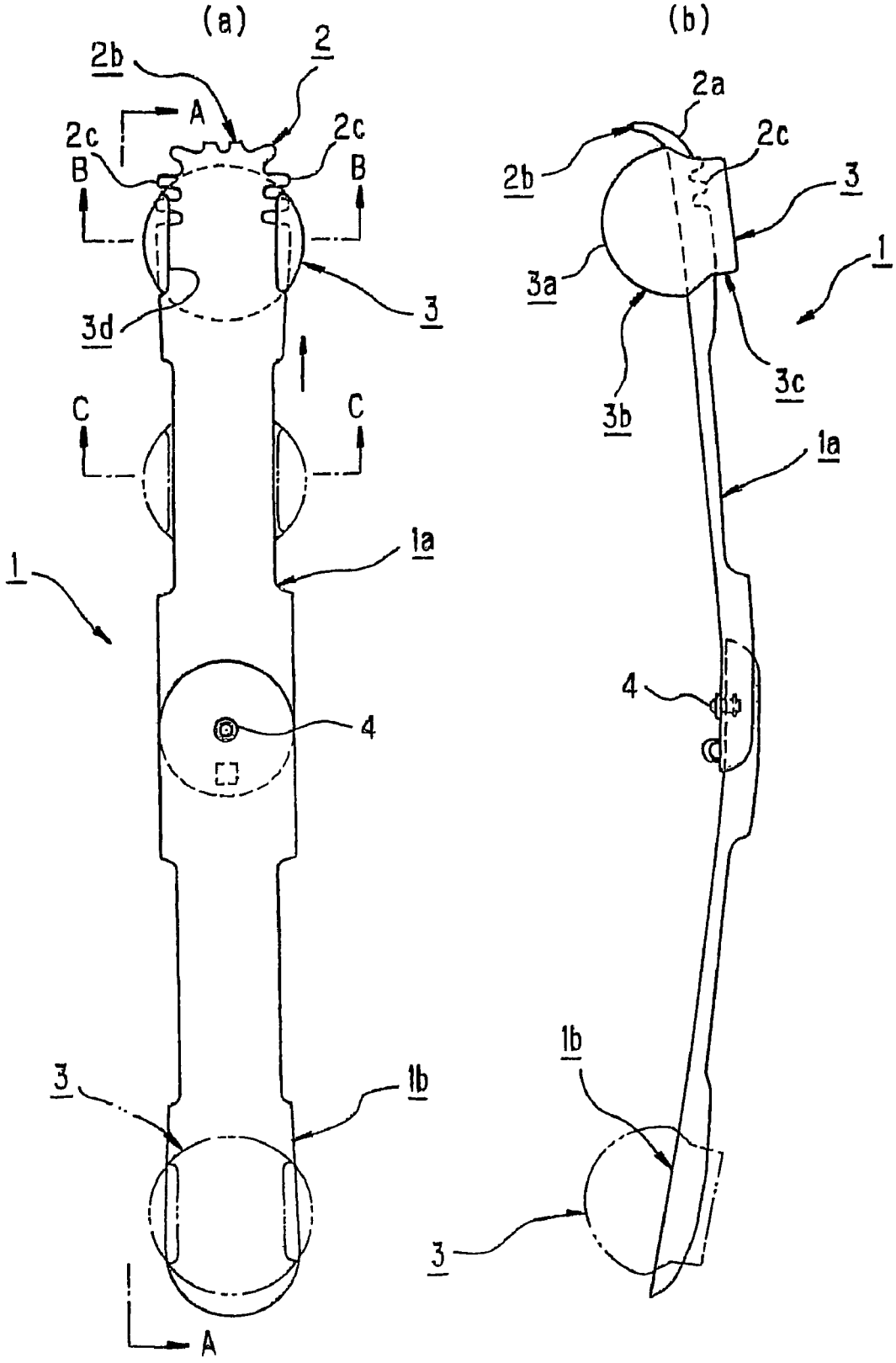
FIG. 1A is a schematic view of a portable shoehorn according to the present invention.
FIG. 1B is a side view of the portable shoehorn as viewed in a direction of arrow line A-A in FIG. 1A.

By sliding the elastic body 3 from the grip section 1*a* to the backscratcher 2 (the shoehorn portion 1*b* of the shoehorn), using the engagement groove 3*d* as shown in FIG. 1, the above-described elastic body 3 for patting a human body is mounted to the backscratcher 2 and the shoehorn portion 1*b* of the shoehorn, using the engagement groove 3*d*.

At this time, the elastic body 3 for patting a human body can be securely mounted to the backscratcher 2 and the shoehorn portion 1*b* of the shoehorn, because both the backscratcher 2 and the shoehorn portion 1*b* of the shoehorn fit with the breadth part of the engagement groove 3*d* by a configuration in which the breadth of the engagement groove 3*d* is a little smaller than those of the backscratcher 2 and the shoehorn portion 1*b* of the shoehorn.

Moreover, it is possible to remove the elastic body 3 from the backscratcher 2 and the shoehorn portion 1*a* of the shoehorn by sliding the elastic body 3 from the backscratcher 2 (the shoehorn portion 1*b* of the shoehorn) to the grip section 1*a*.

That is, as described above, the elastic body 3 for patting a human body is configured to be mounted attachably/detachably to the backscratcher 2 and the shoehorn portion 1*a* of the shoehorn.

Figure 5:
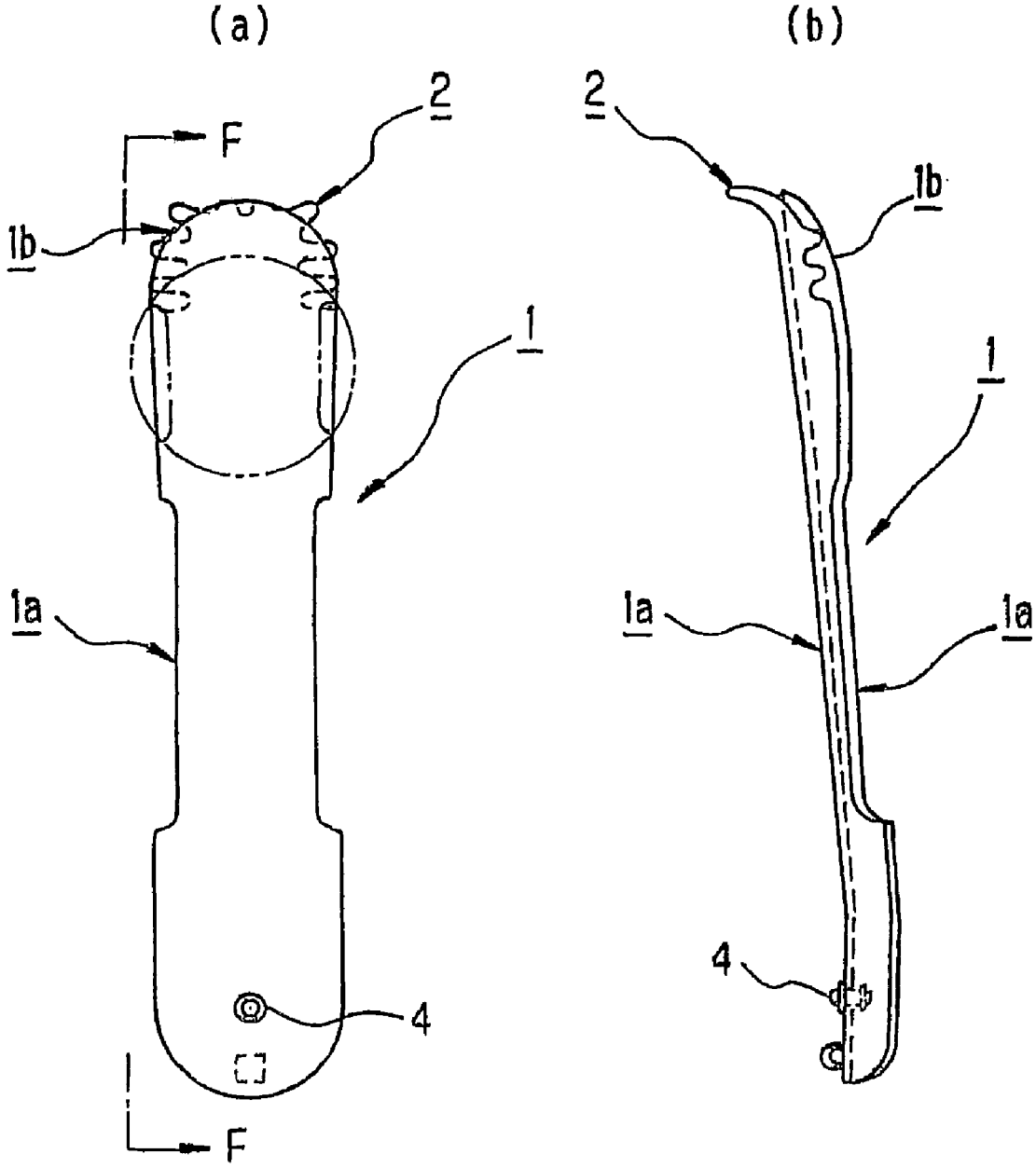
FIG. 5A is a schematic view showing a folded state of the portable shoehorn according to the present invention.
FIG. 5B is a side view of the folded state of the portable shoehorn viewed in a direction of arrow line F-F in FIG. 5A.

The portable shoehorn 1 with the above-described configuration is used as follows:

In the first place, when the portable shoehorn 1 is carried, a grip section 1*a* is fold into two at the central portion to reduce the total length approximately by half by rotating the two members of the grip section 1*a* around the pin 4 at the central portion and by overlapping the two members, as shown in FIG. 5, to make the portable shoehorn 1 compact.

When the elastic body 3 for patting a human body is carried, the elastic body 3 may be separately carried as independent components. For example, however, as shown in FIG. 5A, the body may be mounted to the backscratcher 2 and the shoehorn portion 1*b* of the shoehorn, which have been overlapped together.

Then, when the portable shoehorn 1 carried in a folded state is used, any one of the backscratcher 2 and the shoehorn portion 1*b* of the shoehorn is rotated for opening such that both the backscratcher 2 and the shoehorn portion 1*b* are made into a state like a slender plate, as shown in FIG. 1, which is bent approximately like a bow.

And, when the portable shoehorn 1 is used as a backscratcher or a shoehorn, the backscratcher 2 or the shoehorn portion 1*b* is used in the slender-plate state.

Moreover, when a user relieves his/her body, the elastic body 3 for patting a human body is mounted to the backscratcher 2 or the shoehorn portion 1*b* of the shoehorn as described above, and a stiff part of his/her body is patted in a similar manner to that of shoulder tapping, using a contacting section 3*a* of the main body portion 3*b*.

As described above, according to the portable shoehorn 1 of the present invention, the portable shoehorn can be easily and quickly used, while being carried during travelling, such that the shoehorn portion 1*b* of the shoehorn is used when a user puts on his/her shoes, the backscratcher 2 is utilized when his/her back is itchy, and the elastic body 3 for patting a human body is used like a shoulder tapper when a part of his/her body is required to be relieved, because the portable shoehorn 1 has a configuration in which the portable shoehorn can be folded and can be also used as a backscratcher and a tool with a function for patting a human body.

Figure 6:
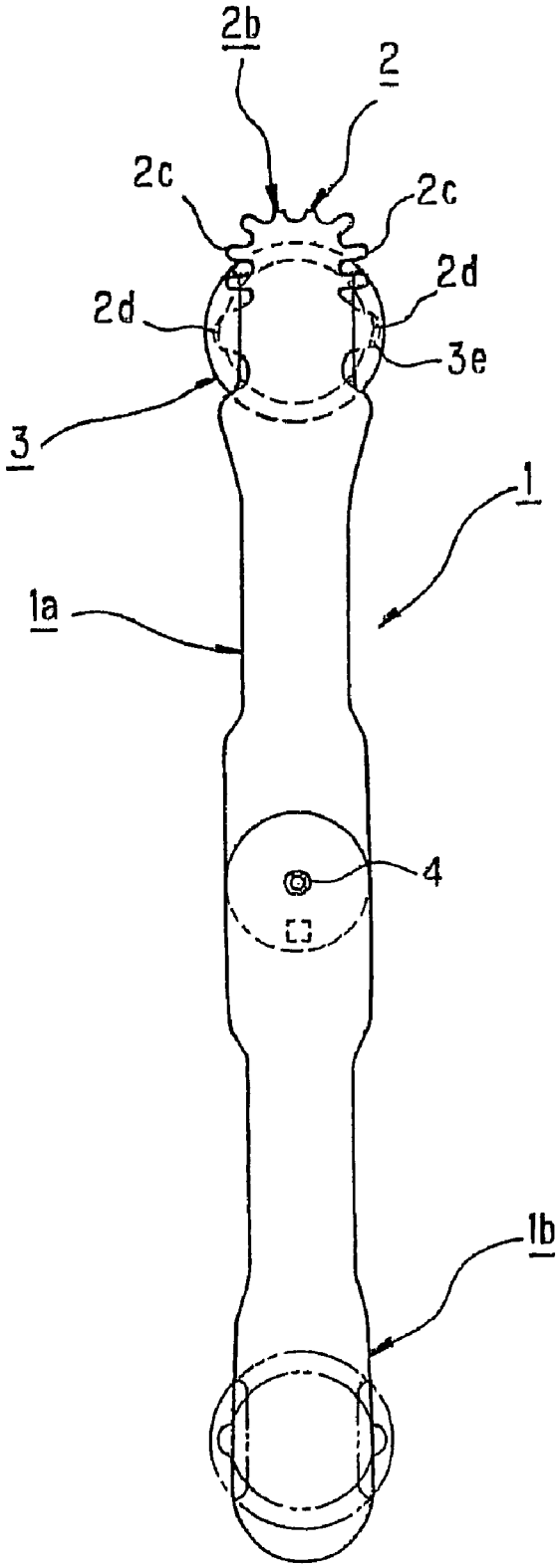
FIG. 6 is a schematic view of a portable shoehorn according to another embodiment of the present invention.
Figure 7:
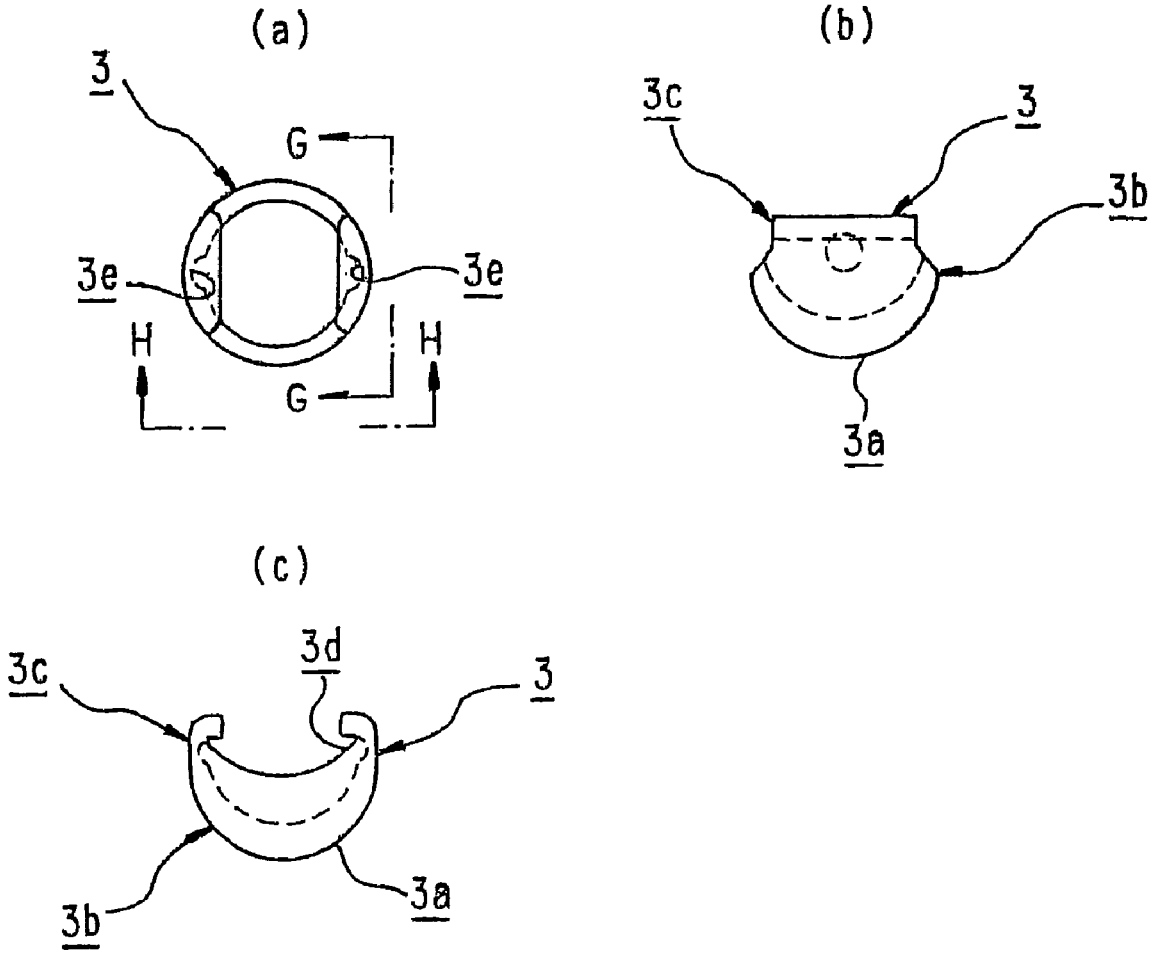
FIG. 7A is a schematic view of an elastic body for patting a human body used for the portable shoehorn shown in FIG. 6.
FIG. 7B is a side view of the elastic body as viewed in a direction of arrow line G-G in FIG. 7A.
FIG. 7C is a side view as viewed in arrow line H-H in FIG. 7A.

FIG. 6 shows a portable shoehorn 1 according to another embodiment of the present invention. Elastic body 3 for patting a human body is mounted, using a plurality of small protruding projections 2*c* provided at right and left edge sections of a backscratcher 2. That is, engagement holes 3*e*, into which small projections 2*c* of the backscratcher 2 are engaged, are formed in the engagement groove 3*d* in the elastic body 3 for patting a human body, as shown in FIG. 7.

In this embodiment, one of the small projections 2*c* at the right and left edge sections of the backscratcher 2 is enlarged in the size, and is engaged into one of engagement projections 2*d* for prevention of loosing (Refer to FIG. 6), and, at the same time, the engagement holes 3*e* (Refer to FIG. 7), into which the engagement projections 2*d* for prevention of loosing are engaged, are formed in the engagement groove 3*d* of the elastic body 3 for patting a human body.

As the above-described configuration, by mounting the elastic body 3 for patting a human body to the backscratcher 2, the elastic body 3 for patting a human body can be more securely mounted to the backscratcher 2 without loosing and the mounted state is maintained even when the human body is patted many times, using the elastic body 3.

Furthermore, the small projections 2*c* at the right and left edge sections of the backscratcher 2 can be used, for example, in the case where a rubber band to fix a cloth for ointment application is held when ointment is applied on his/her back.

INDUSTRIAL APPLICABILITY

As described above, in view of times of the low birthrate and the aging population, the portable shoehorn according to the present invention can support the movement of elderly people in their daily lives, and is convenient to carry as a miniaturized tool because it is lightweight and foldable.

What is claimed is:

1. A portable shoehorn which is a shoehorn obtained by bending a plate member, which has been bent in a breadth direction thereof, in a longitudinal direction thereof approximately like a long bow to form a slender plate shape and whose grip section is constituted so as to be folded into two parts at a central portion thereof to reduce an entire length of the shoehorn approximately by half, wherein a backscratcher is formed at a distal end of the grip section and an elastic body for patting a human body is constituted so as to be removeably mounted to a portion of the backscratcher and a shoehorn portion of the shoehorn, and wherein the elastic body is mounted on a same side as protruding projections of the backscratcher when the elastic portion is mounted to the portion of the backscratcher.

2. A portable shoehorn which is a shoehorn obtained by bending a plate member, which has been bent in a breadth direction thereof, in a longitudinal direction thereof approximately like a long bow to form a slender plate shape and whose grip section is constituted so as to be folded into two parts at a central portion thereof to reduce an entire length of the shoehorn approximately by half, wherein a backscratcher is formed at a distal end of the grip section and an elastic body for patting a human body is constituted so as to be removeably mounted to a portion of the backscratcher and a shoehorn portion of the shoehorn, wherein the grip section is formed such that the breadth thereof is shorter than those of the backscratcher and the shoehorn portion of the shoehorn, and the elastic body for patting a human body comprises a main body portion with a spherically formed face contacting with a human body and a mounting portion which is applied to be mounted to the backscratcher and the shoehorn portion of the shoehorn; and the mounting portion of the shoehorn of the elastic body for patting a human body is formed with an engagement groove with a groove breadth which allows engagement with the backscratcher and the shoehorn portion of the shoehorn without allowing engagement with the grip section.

3. A portable shoehorn which is a shoehorn obtained by bending a plate member, which has been bent in a breadth direction thereof, in a longitudinal direction thereof approximately like a long bow to form a slender plate shape and whose grip section is constituted so as to be folded into two parts at a central portion thereof to reduce an entire length of the shoehorn approximately by half, wherein a backscratcher is formed at a distal end of the grip section and an elastic body for patting a human body is constituted so as to be removeably mounted to a portion of the backscratcher and a shoehorn portion of the shoehorn, wherein the backscratcher is constituted with a corrugated projection provided at a bent end formed by bending a distal end thereof and a plurality of small projections provided in a projecting manner at left and right side edges near the bent portion; and the engagement groove of the elastic body for patting a human body is formed with engagement holes engaged with the small projections of the backscratcher.

4. A portable shoehorn comprising:

a bent plate member, said member comprising a grip section and a shoehorn section, each of said grip section and said shoehorn section (1) being bent in a breadth-wise direction thereof and in a longitudinal direction thereof approximately like a long bow to form a slender plate shape, (2) having a distal end and a proximal end at which said sections are rotatably joined to form a central portion, and (3) being foldable into two parts at said central portion to reduce an entire length of the shoehorn approximately by half, a backscratcher formed at the distal end of the grip section and a shoehorn formed at the distal end of the shoehorn section, an elastic body for patting a human body, said elastic body comprising a main body portion and a mounting portion, said mounting portion being operative for removeable mounting of the elastic body to at least one of the grip section and the shoehorn section, and wherein the elastic body is mounted on a same side as protruding projections of the backscratcher when the elastic portion is mounted to the portion of the backscratcher.

5. A portable shoehorn comprising:

a bent plate member, said member comprising a grip section and a shoehorn section, each of said grip section and said shoehorn section (1) being bent in a breadth-wise direction thereof and in a longitudinal direction thereof approximately like a long bow to form a slender plate shape, (2) having a distal end and a proximal end at which said sections are rotatably joined to form a central portion, and (3) being foldable into two parts at said central portion to reduce an entire length of the shoehorn approximately by half, a backscratcher formed at the distal end of the grip section and a shoehorn formed at the distal end of the shoehorn section, and an elastic body for patting a human body, said elastic body comprising a main body portion and a mounting portion, said mounting portion being operative for removeable mounting of the elastic body to at least one of the grip section and the shoehorn section, wherein the mounting portion of said elastic body is shaped with an engagement groove to fit over and securely engage edges at a bend in the breadthwise direction of at least one of the grip portion and the shoehorn portion.

6. A portable shoehorn comprising:

a bent plate member, said member comprising a grip section and a shoehorn section, each of said grip section and said shoehorn section (1) being bent in a breadth-wise direction thereof and in a longitudinal direction thereof approximately like a long bow to form a slender plate shape, (2) having a distal end and a proximal end at which said sections are rotatably joined to form a central portion, and (3) being foldable into two parts at said central portion to reduce an entire length of the shoehorn approximately by half, a backscratcher formed at the distal end of the grip section and a shoehorn formed at the distal end of the shoehorn section, and an elastic body for patting a human body, said elastic body comprising a main body portion and a mounting portion, said mounting portion being operative for removeable mounting of the elastic body to at least one of the grip section and the shoehorn section, wherein the mounting portion of said elastic body is shaped with an engagement groove to fit over and securely engage edges at a bend in the breadthwise direction of both the grip portion and the shoehorn portion.

* * * * *